US005977712A

United States Patent [19]

Simpson

[11] Patent Number: 5,977,712

[45] Date of Patent: Nov. 2, 1999

[54] INDUCTIVE TUNERS FOR MICROWAVE DRIVEN DISCHARGE LAMPS

[75] Inventor: James E. Simpson, Gaithersburg, Md.

[73] Assignee: Fusion Lighting, Inc., Rockville, Md.

[21] Appl. No.: 08/787,175

[22] Filed: Jan. 23, 1997

Related U.S. Application Data

[60] Provisional application No. 60/010,671, Jan. 26, 1996.

[51] Int. Cl.[6] ..... H01J 65/04

[52] U.S. Cl. ..... 315/39; 315/248

[58] Field of Search ..... 315/39, 248, 267, 315/344; 333/208

[56] References Cited

U.S. PATENT DOCUMENTS

| | | | |
|---|---|---|---|
| 3,911,318 | 10/1975 | Spero et al. | 315/39 |
| 3,993,927 | 11/1976 | Haugsjaa et al. | 315/39 |
| 4,002,944 | 1/1977 | Mc Neill et al. | 315/39 |
| 4,042,850 | 8/1977 | Ury et al. | 315/39 |
| 4,975,625 | 12/1990 | Lynch et al. | 315/344 |
| 4,990,829 | 2/1991 | Christensen | 315/248 X |
| 5,404,076 | 4/1995 | Dolan et al. | 315/248 X |

FOREIGN PATENT DOCUMENTS

| | | | |
|---|---|---|---|
| 62-061261 | 3/1987 | Japan | H01J 65/04 |

OTHER PUBLICATIONS

Principles and Applications of Waveguide Transmission, George C. Southworth, Bell Telephone Laboratories, Inc., D. Van Nostrand Company, Inc., pp. 246–259.

Waveguide Handbook, N. Marcuvitz, Office of Scientific Research and Development National Defense Research Committee, First Edition, McGraw–Hill, 1951, pp. 218–273.

*Primary Examiner*—Benny T. Lee

[57] ABSTRACT

An RF powered electrodeless lamp utilizing an inductive tuner in the waveguide which couples the RF power to the lamp cavity, for reducing reflected RF power and causing the lamp to operate efficiently.

26 Claims, 3 Drawing Sheets

INDUCTIVE TUNERS FOR MICROWAVE DRIVEN DISCHARGE LAMPS

CROSS-REFERENCE TO RELATED APPLICATIONS

The present application is based on provisional application Ser. No. 60/010,671, filed Jan. 26, 1996.

This invention was made with Government support under Contract No. DE-FG01-95EE23796 awarded by the Department of Energy. The Government has certain rights in this invention.

BACKGROUND OF THE INVENTION a. Field of the Invention

This invention refers to the field of radio-frequency (RF) driven arc lamps in which the structure includes a closed waveguide, and particularly to those lamps which utilize a magnetron as the source of power.

b. Description of the Prior Art

These lamps employ an ionizable medium enclosed in a sealed transparent envelope which produces visible light or ultraviolet light when excited by an intense microwave field. The lamp envelope or bulb is enclosed in a metal container or cavity which confines the microwaves while providing for the escape of the light, usually by means of a metal screen. Microwaves are admitted into the cavity through an aperture which connects to the adjoining waveguide, the other end of which couples to the magnetron.

RF power from the magnetron travels through the waveguide to the cavity and excites the discharge lamp. Any power that is not absorbed by the lamp reflects back to the magnetron. The aperture defining the end of the cavity may be used to define a resonance in the cavity which intensifies the fields at the bulb to provide increased power absorption, thus reducing the reflected power.

A magnetron is a self-excited oscillator with a direct connection between its resonator and the output load. Any reflection from the load has a strong effect on the performance, changing the operating frequency, the power output and the operating stability. Strong reflections at a particular phase known as the "sink" reduce the stored energy in the magnetron's resonator, causing instability and frequency jumping.

The lamp itself places several different requirements on its power source. Before ionization, gases in the bulb do not absorb microwave power. The electric field intensity within the bulb must be built up to a high level to achieve breakdown. Once ionization occurs, the bulb must heat to evaporate any condensed fill materials. The impedance of the bulb is much lower than the non-ionized case, and changes as the bulb heats, bringing the condensates into the discharge. And finally the long term operating condition is reached in which light output efficiency is the dominant concern.

These impedance changes result in a variety of reflected values at the magnetron. The designer can adjust the aperture of the cavity, the length of the waveguide and may add a variety of tuning elements into the waveguide. The goal is to keep the high reflection before ionization away from the sink, to avoid frequency-jumping during the warm-up cycle and to provide a good match with stable characteristics during long-term operation.

Other considerations may also enter into the design. The product needs to be economical, compact in size, durable, and reproducible. Cost prevents the use of isolators. Compact size holds the waveguide to a minimum length.

While many types of irises and posts are well-known in microwave design, the tuning element frequently used in microwave arc lamps is the capacitive screw or a fixed height knob of the same size. This has the advantage of attaching to only one wall and is more easily installed than a post which must contact two opposite walls. When a waveguide length (between the magnetron antenna and the coupling slot) greater than half a guide-wavelength is available, this capacitive tuner may be used to match a moderate mismatch of any phase. The tuner has two effects. The reflection coefficient is added to the reflection coefficient of the load beyond it. Secondly, the effective length of the waveguide is increased by a small amount.

SUMMARY OF THE INVENTION

In the course of making a new lamp design, the cavity and the coupling iris were established. The waveguide length and magnetron position were also established. However, the impedance match was not optimum and the waveguide length (referred to in the preceding paragraph) was less than half a wavelength. Attempts to add a capacitive tuner showed that it was unsuitable, the best location being directly above the magnetron antenna.

An inductive tuner was placed on the side wall of the waveguide between the magnetron and the cavity aperture. A metal protrusion at the side of a waveguide acts like an inductive iris, raising the cutoff frequency of the waveguide at its location. Thus, the tuner provides a reflection coefficient with an inductive phase and shortens the effective length of the waveguide a small amount. The lamp design operates efficiently with this tuner. The inductive tuner may be a single block, semi-cylinder, or hemisphere or combination thereof attached to one side wall, or two such objects may face each other on opposite walls. These shapes are appropriate where the tuners are to be installed in a waveguide after it is built, as for example, by screws, soldering or welding.

The tuner may also be molded into the waveguide wall. Depending upon the method of construction it may be advantageous to form the tuner to join to the upper and/or lower broad wall of the waveguide as a thick iris.

DESCRIPTION OF PREFERRED EMBODIMENTS

Figure 1:
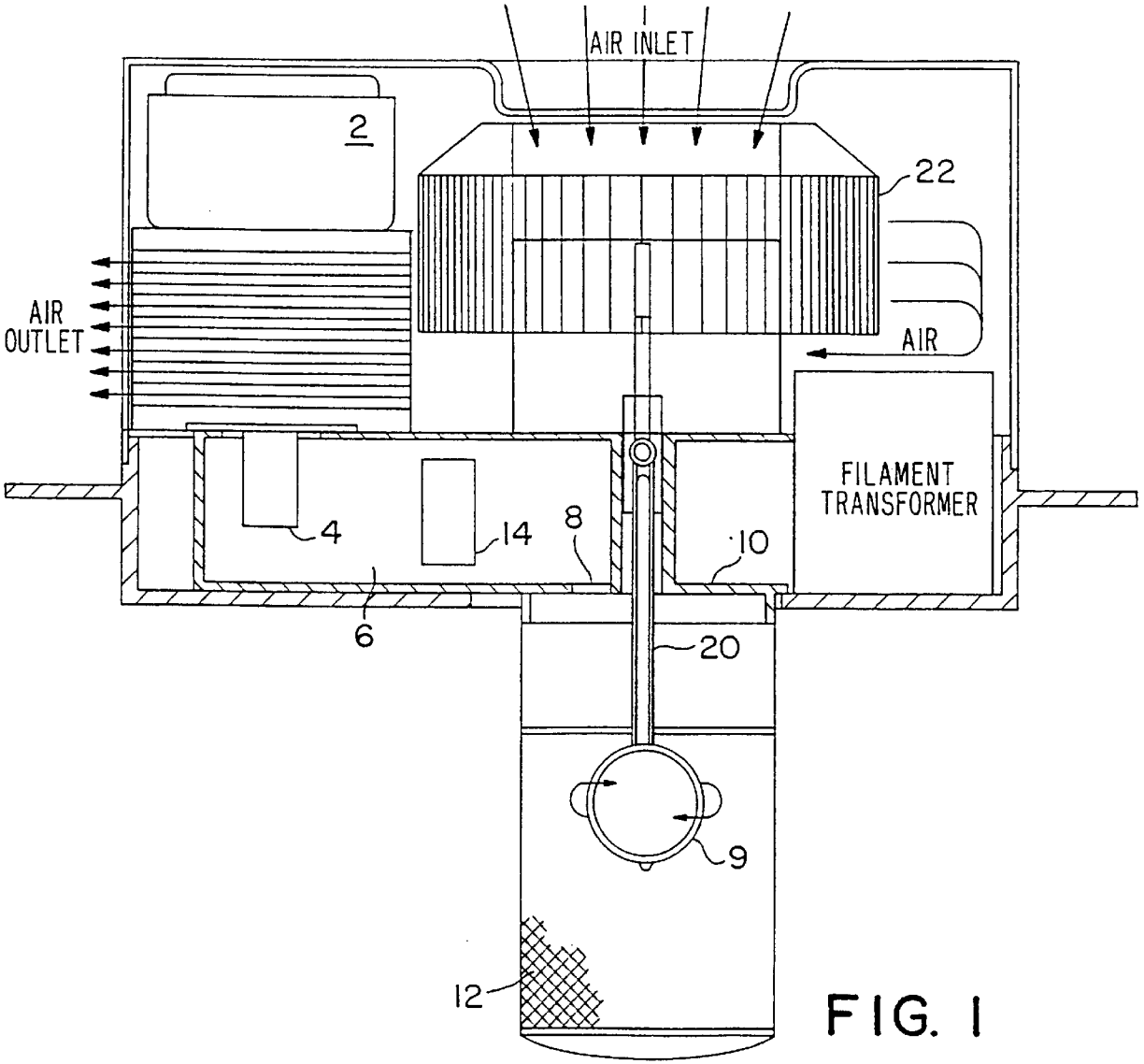
FIG. 1 is a schematic representation of a microwave lamp.

Referring to FIG. 1, a microwave lamp is shown. Magnetron 2 has antenna 4 which protrudes into closed waveguide 6. At the other end of the waveguide, coupling slot 8 is located, which couples microwave power into the resonant cavity defined by bottom 10 and RF screen 12 in which bulb 9 is located. In accordance with the invention, inductive tuner 14 is attached to a side wall of the waveguide 6. Preferably, according to the invention, the waveguide length from the antenna of the magnetron to the coupling slot is less than half a wavelength.

It is noted that the waveguide has broad walls and narrow walls (side walls). Since the magnetic field is high at the side walls, a metal protrusion placed there will act as an inductive tuner.

In any given lamp, the location of the tuner as well as its size and shape are determined by experimentation, with the aid of a network analyzer. As known to those skilled in the art, the network analyzer is first calibrated with the aid of a sliding short. The impedance is then observed with the lamp in the starting and running conditions without a tuner. If significant reflection is present when the lamp is at operating temperature a tuner of trial size and shape is used and its position changed to determine the position of optimum operation. If significant reflection is still present, the size and/or shape of the tuner is varied, and various positions again tried.

In the embodiment of FIG. 1, rectangular waveguide 6 is 1.7" high by 2.84" wide, and 4.8" long on the inside. The distance from the middle of the tuner to the slot end of the waveguide is about 1⅞", and the tuner is about ⅝" wide by 1¼" long, and has a thickness of about 0.35". The coupling slot 8 is 2⅜" long and 0.53" wide. The microwave cavity is 2.93" in diameter and 6.2" tall. The bulb 9 is 35 mm inside diameter and contains a fill of sulfur and rare gas such as argon.

Both the waveguide and the tuner may be made of aluminum. It is preferable to make the waveguide and the tuner of the same material to minimize corrosion.

A motor rotates both the shaft 20 to which bulb 9 is attached nd blower wheel 22 which provides air for cooling the magnetron 2. As illustrated in FIG. 1, the blower wheel 22 draws in air through an AIR INLET and blows the air out through an AIR OUTLET. Also illustrated is a FILAMENT TRANSFORMER which provides current to a filament of the magnetron 2.

Figure 2:
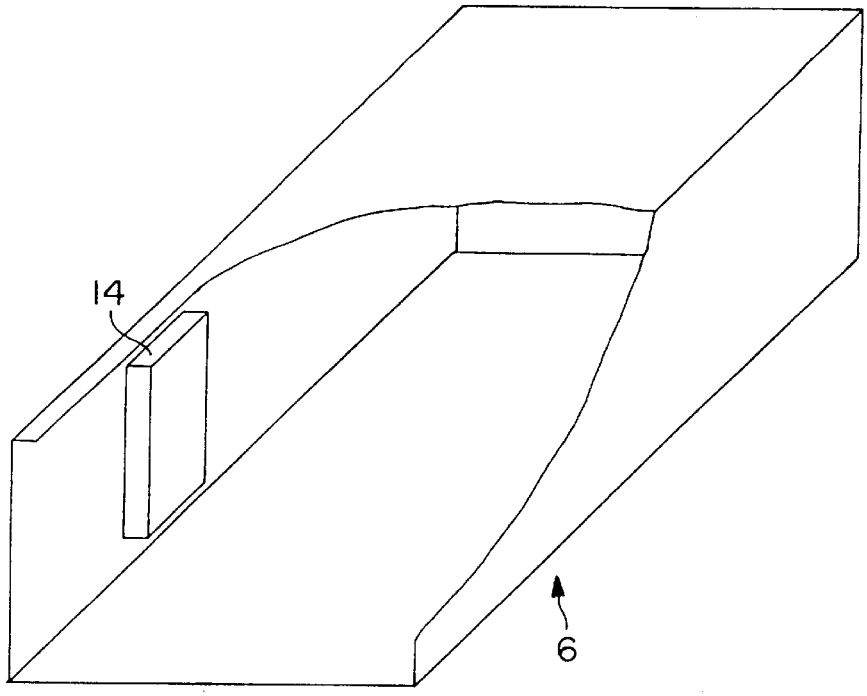
FIG. 2 illustrates an inductive tuner in the form of a single block.

FIG. 2 is a cut-away detail of waveguide 6 of FIG. 1, and shows the inductive tuner in the form of metal block 14.

Figure 3:
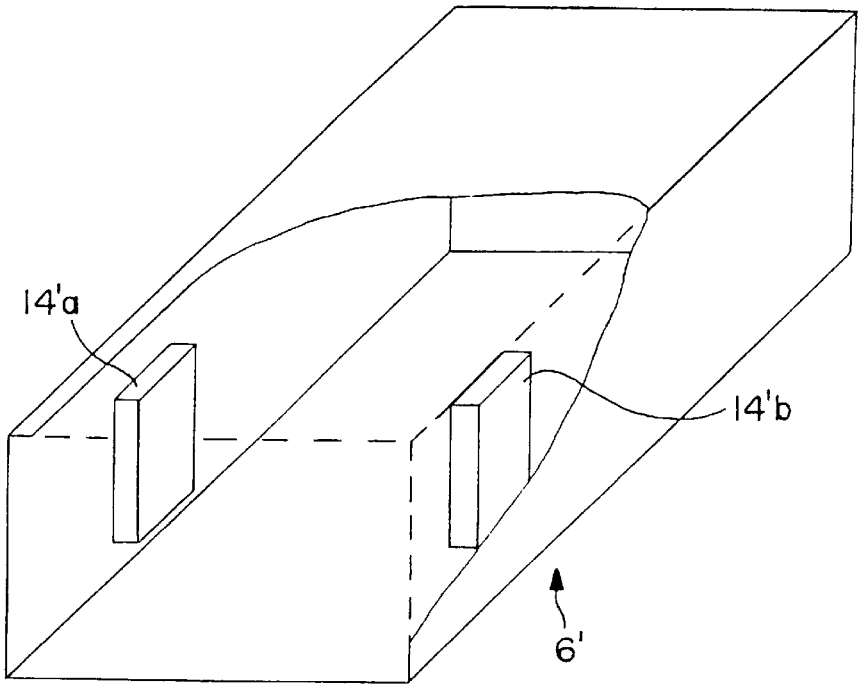
FIG. 3 illustrates an inductive tuner in the form of two blocks which face each other on opposite waveguide walls.

FIG. 3 shows an alternative embodiment of a waveguide 6" wherein two such blocks 14'*a* and 14'*b* face each other on opposite waveguide walls.

Figure 4:
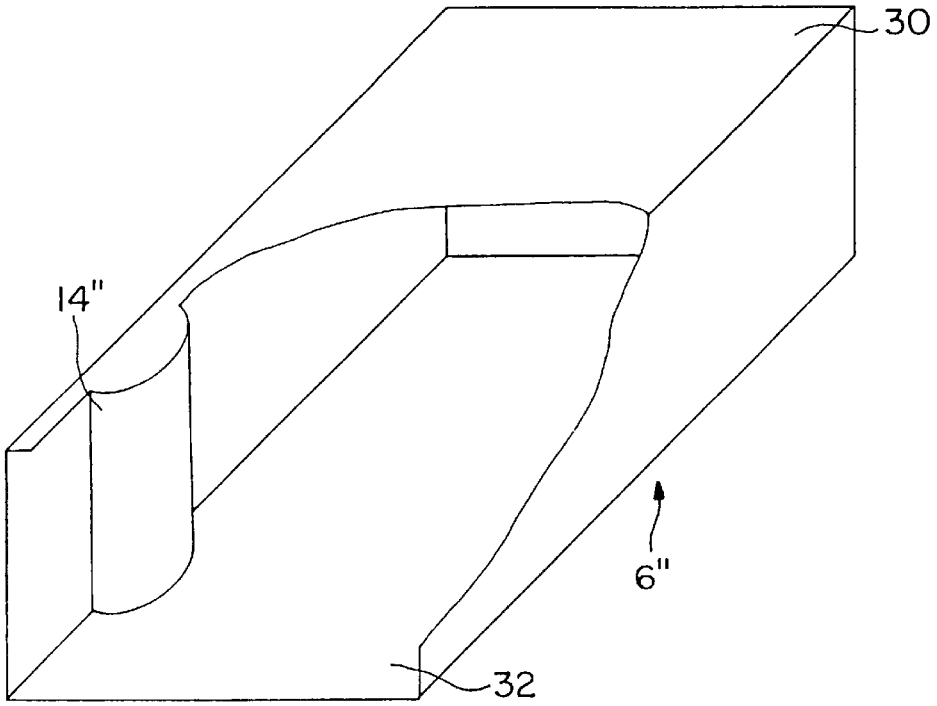
FIG. 4 illustrates an inductive tuner in the form of a semicylinder contacting the broad walls of a waveguide.

FIG. 4 shows a further alternative embodiment of a waveguide 6' which utilizes a protrusion in the form of semicylinder 14" which contacts the top and bottom broad walls 30 and 32 of the waveguide. As shown in FIG. 4, the semicylinder 14" is molded in one of the narrow walls of the waveguide 6.

Figure 5:
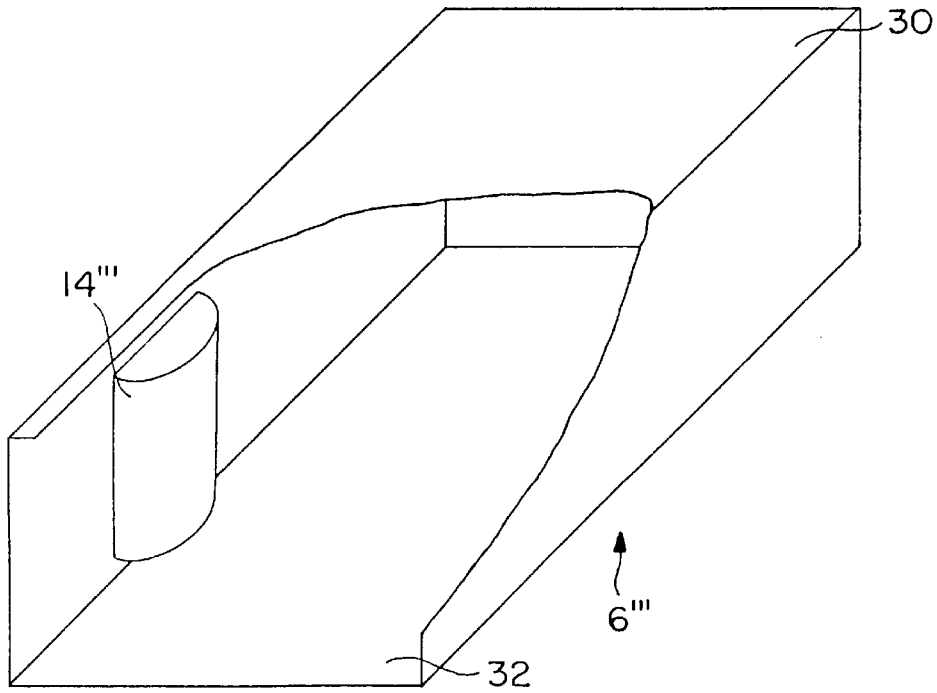
FIG. 5 illustrates an inductive tuner in the form of a semicylinder which does not contact the broad walls of a waveguide.

FIG. 5 shows still a further embodiment of a waveguide 6'" which utilizes semicylinder 14'" which does not contact the broad walls 30 and 32 of the waveguide.

While the invention has been disclosed employing illustrative embodiments, it is to be understood that variations will occur to those skilled in the art. For example the tuners may have different shapes than illustrated, or cylindrical posts may be used. The scope of the invention is defined by the following claims.

I claim:

1. An RF powered electrodeless lamp, comprising:

means for generating RF power, a bulb containing a discharge forming medium disposed in a cavity, a waveguide for coupling said RF power from said means for generating RF power to said cavity, said waveguide comprising narrow walls and broad walls, and inductive tuning means disposed in said waveguide on or across at least one of said narrow walls for minimizing said RF power which is reflected back from said cavity to said means for generating RF power.

2. The lamp as recited in claim 1, wherein said waveguide has a coupling slot therein.

3. The lamp as recited in claim 2, wherein the means for generating RF power comprises a magnetron having an antenna and wherein the waveguide has a length extending from the antenna to the coupling slot which is less than half a wavelength of the RF power.

4. An RF powered electrodeless lamp, comprising:

means for generating RF power;

a bulb containing a discharge forming medium disposed in a cavity;

a waveguide for coupling said RF power from said generating means to said cavity, said waveguide comprising narrow walls and broad walls, said waveguide having a coupling slot therein, and an inductive tuner disposed in said waveguide, wherein said inductive tuner comprises a metal block disposed on or across at least one of said narrow walls.

5. The lamp as recited in claim 4, wherein said metal block is rectangular.

6. The lamp as recited in claim 4, wherein said inductive tuner comprises two rectangular metal blocks disposed on oppositely positioned narrow walls of the waveguide.

7. The lamp as recited in claim 4, wherein said metal block comprises a semi-cylindrical metal block.

8. The lamp as recited in claim 7, wherein said metal block contacts said respective broad walls at extreme ends of said metal block.

9. The lamp as recited in claim 7, wherein said metal block has extreme ends which do not contact said broad walls.

10. The lamp as recited in claim 4, wherein the means for generating RF power comprises a magnetron having an antenna and wherein the waveguide has a length extending from the antenna to the coupling slot which is less than half a wavelength of the RF power.

11. An RF powered electrodeless lamp, comprising:

an RF power source;

a waveguide connected to the RF power source, the waveguide including a coupling slot and comprising narrow walls and broad walls;

a resonant cavity connected to the waveguide and configured to receive RF power from the coupling slot;

a bulb containing a discharge forming medium disposed in the resonant cavity; and an inductive tuner disposed in the waveguide on or across at least one of said narrow walls.

12. The lamp as recited in claim 1, wherein the inductive tuner comprises two metal protrusions disposed on oppositely positioned narrow walls of the waveguide.

13. The lamp as recited in claim 12, wherein each of the two metal protrusions comprises a respective metal block.

14. The lamp as recited in claim 13, wherein each of the metal blocks is rectangular.

15. The lamp as recited in claim 11, wherein the inductive tuner comprises at least one metal protrusion disposed on a narrow wall of the waveguide.

16. The lamp as recited in claim 15, wherein the at least one metal protrusion comprises a metal block.

17. The lamp as recited in claim 16, wherein the metal block is rectangular.

18. The lamp as recited in claim 15, wherein the metal block comprises a semi-cylindrical metal block.

19. The lamp as recited in claim 18, wherein the semi-cylindrical metal block contacts respective broad walls of the waveguide at extreme ends of the semi-cylindrical metal block.

20. The lamp as recited in claim 11, wherein the RF power source comprises a magnetron having an antenna and wherein the waveguide has a length extending from the antenna to the coupling slot which is less than half a wavelength of the RF power.

21. A method of reducing reflected RF power in an RF powered electrodeless lamp having an RF power source connected to a resonant cavity via a coupling slot in a waveguide comprising narrow walls and broad walls, the method comprising the steps of:

disposing an inductive tuner in the waveguide on or across at least one of the narrow walls of the waveguide; and positioning the inductive tuner to reduce reflection of the RF power from the cavity back to the RF source.

22. The method as recited in claim 21, wherein the step of positioning the inductive tuner in the waveguide comprises:

securing a metal protrusion to at least one of the narrow walls of the waveguide.

23. The method as recited in claim 21, wherein the step of positioning the inductive tuner in the waveguide comprises:

molding a metal protrusion in at least one of the narrow walls of the waveguide.

24. The lamp as recited in claim 21, wherein the RF power source comprises a magnetron having an antenna and wherein the waveguide has a length extending from the antenna to the coupling slot which is less than half a wavelength of the RF power.

25. The method as recited in claim 21, wherein the step of positioning the inductive tuner comprises:

observing an impedance of the lamp under starting and operating conditions;

changing a position of the inductive tuner to determining a position of optimum operation for the inductive tuner; and securing the inductive tuner at the position of optimum operation.

26. The method as recited in claim 21, wherein the step of positioning the inductive tuner in the waveguide comprises:

securing a metal block to at least one of the narrow walls of the waveguide.

* * * * *